US005729080A

United States Patent [19]

Verspaget et al.

[11] Patent Number: 5,729,080

[45] Date of Patent: Mar. 17, 1998

[54] ELECTRIC LAMP WITH MOUNTING MEMBERS

[75] Inventors: Godefridus N. M. Verspaget; Hendrikus A. M. Van Dulmen, both of Eindhoven, Netherlands; Mathijs H. Loomans, Turnhout, Belgium

[73] Assignee: U.S. Philips Corporation, New York, N.Y.

[21] Appl. No.: 700,700

[22] Filed: Jul. 10, 1996

[30] Foreign Application Priority Data

Jul. 11, 1995 [EP] European Pat. Off. ..... 95201891

[51] Int. Cl.[6] ..... H01J 5/48

[52] U.S. Cl. ..... 313/318.01; 313/318.09; 313/318.1

[58] Field of Search ..... 313/318.01, 318.02, 313/318.07, 318.09, 318.1; 362/217, 223; 439/611

[56] References Cited

U.S. PATENT DOCUMENTS 4,943,897 7/1990 Van Heeswijk et al. ..... 362/223

5,410,213 4/1995 Harchenko et al. ..... 313/318.1

*Primary Examiner*—Ashok Patel
*Assistant Examiner*—Vip Patel
*Attorney, Agent, or Firm*—Walter M. Egbert, III

[57] ABSTRACT

The electric lamp has a lamp vessel (1) having first (2) and second (3) opposed necks, each having an end portion (4). Current conductors (7) extend from an electric element (5) having an axis (6) through a respective neck (2,3) and end portion (4) to the outside. Mounting members (10, 11) are secured to each of the necks (2,3), remote from the end portions (4). Each mounting member has a first metal body (20) which is fixed to the neck in a selected area. A second metal body (30) is secured to the first metal body (20), and has an aligned surface (31) which is in at least one of three perpendicular directions (x,y,z) in an aligned position with respect to the electric element (5). Each mounting member furthermore has a third metal body (40) having references (12) which is secured to the aligned surface (31), such that its references (12) are in a predetermined aligned position with respect to the electric element (5). The construction of the lamp allows for a fast and accurate assembling, and is light and little bulky.

10 Claims, 4 Drawing Sheets

ELECTRIC LAMP WITH MOUNTING MEMBERS

BACKGROUND OF THE INVENTION

The invention relates to an electric lamp comprising:

a light-transmitting lamp vessel which is closed in a vacuumtight manner and which has a first and a second neck in mutual opposition, each neck having an end portion;

an electric element having an axis in the direction of said necks and arranged in the lamp vessel;

current conductors extending from the electric element through the first and second neck from the respective end portions to the exterior;

a first and a second mounting member fastened to the first and the second neck, respectively, which mounting members each have reference portions which in a direction z parallel to the axis and in directions x, y transverse to the axis have predetermined positions relative to the electric element.

Such an electric lamp is known from U.S. application Ser. No. 4,943,897.

The known lamp is designed for use in an optical system. It is necessary in this application for the electric element to occupy automatically a predetermined position upon mounting of the lamp in such a system. The known lamp has mounting members with reference portions for this purpose.

In the known lamp, the mounting members are ceramic lamp caps which are fixed with cement around the end portions of the necks, neck-shaped portions. The mounting members are at the same time carriers of electric contacts which are connected to the current conductors and which are designed for being connected to an electric supply Source.

The reference portions of the mounting members here are on the one hand cylindrically curved surfaces which are to cooperate with support surfaces situated on the legs of a V in the optical system so as to position the lamp in directions x and y transverse to the axis, and on the other hand projections directed transverse to the axis which are to position the lamp in axial direction, the z-direction.

It is a disadvantage of the use of cement for fastening the lamp caps that the lamp caps and the lamp must be held in the aligned position until the cement has cured. This delays the manufacturing process of the lamp. Ceramic lamp caps in addition have the disadvantage that they must have comparatively thick walls to obtain their mechanical strength, so that they are comparatively voluminous, and that they are comparatively expensive. The lamp caps are mounted in end positions because of the electrical contacts which are connected to current conductors which issue to the exterior from the end portions of the lamp. If lamps are comparatively big in axial direction, which may be necessary, for example, for having the current conductors issue from the necks to the exterior at a sufficiently low temperature, the end portions must have a comparatively great lateral displaceability in the lamp caps during alignment in order to render it possible to position the lamp caps relative to an electric element mounted askew in the lamp vessel. This limits the accuracy with which alignment can be carried out, or requires extra voluminous lamp caps.

SUMMARY OF THE INVENTION

It is an object of the invention to provide an electric lamp of the kind described in the opening paragraph which has mounting members which are of a simple construction and can be mounted with easy alignment possibility.

According to the invention, this object is achieved in that the first and the second mounting member are present at a distance from the end portion and each comprise a first metal body which is mounted on the associated neck in a region at a distance from the end portion and each comprise a second metal body which is fastened to the first metal body, the second metal body having an aligned surface which is aligned relative to the electric element in at least one of the directions x, y and z, and each have a third metal body which is provided with the reference portions and which is fastened against said aligned surface of the second metal body such that the reference portions have the predetermined positions relative to the electric element.

The mere fact that in an optical system the mechanical fastening and electrical contacting take place in different locations of the lamp vessel is already an advantage of the electric lamp according to the invention. As a result, the mounting members may be provided comparatively far removed from the end portions, if so desired, and the necks may on the other hand be comparatively long, if so desired, so as to have the current conductors issue to the exterior in a comparatively cool state, without affecting the accuracy with which the lamp can be aligned. In addition, the mounting members are not live now.

It is also an advantage that the mounting members are made of metal because they can now be light, of small volume, and easy to manufacture. Another advantage is that the first metal body is mounted without alignment in a chosen region of the necks. This mounting operation may accordingly take place outside an alignment unit. This also renders possible a plurality of constructions and shapes of said body. The first metal body only serves to give the lamp vessel a metal surface so that the second metal body can be fastened by means of a metal-metal joint. The body may be, for example, a sleeve which is closed mechanically or through welding. The body may even be a, for example cylindrical, tube which is fixed with cement, if so desired. Curing of the cement is of little import because it can take place outside an alignment unit, possibly at room temperature. The second metal body may then be, for example, a U-shaped strip whose base is fixed, for example, at a preset distance to the axis and in a preset position along the axis.

It is favorable when the first metal body is a clip with legs interconnected by a base, which clip clamps with its legs around the neck. The body may then be simply pressed home on the neck. It is favorable, for example in the above case, when the neck has a relief at a surface at the area of the first metal body, which relief locks the body against shifting in axial direction. It is ensured thereby that the body will lie within a predetermined region of the neck during the subsequent mounting steps. The neck may for this purpose have, for example, a recessed portion, or one or several bulges which cooperate with a recess or an opening in the first metal body.

In a special embodiment, the first metal body has at its legs tongues which are welded to the second metal body and which in a favorable embodiment are directed transverse to said legs. The first metal body may then be constructed as a clip with a weak-spring characteristic for easy mounting, changing into a clip with a stiffer-spring characteristic upon fastening of the tongues to the second metal body so as to grip the neck securely. Tongues transverse to the legs here provide the clip with an extra rigidity.

The second metal body is aligned with its aligned surface relative to the electric element in at least one of the directions x, y and z before and during fastening of the first metal body to the second metal body. This alignment may be effected in that the two second metal bodies are placed in a jig and the lamp vessel with the two first metal bodies is introduced into this jig and moved until the electric element has been brought to within a chosen tolerance area in the desired direction(s). The metal bodies may then be interconnected two-by-two, for example with welds, for example with resistance welds or laser welds. During alignment it is possible to set, for example, the distance from the aligned surface to the axis (y-direction). It is convenient when the second metal body has for this purpose a fastening surface which is transverse to its aligned surface and to which the first metal body is fastened. The aligned surface may in that case be positioned also with lateral alignment relative to the axis, i.e. in the x-direction.

In a favorable embodiment, the second metal body is substantially U-shaped and positioned around the axis. The second metal body then has a base which forms the aligned surface and legs which are interconnected by the base. It is then possible, for example, that either exclusively the distance from the base to the axis (y-direction), or also the lateral positioning of the base relative to the axis (x-direction), or alternatively the axial position (z-direction) is set.

The third metal body may also be substantially U-shaped and be arranged around the axis. This body then has a base which is fastened against, for example to, the aligned surface of the second metal body and legs which are interconnected by the base and which may each have a reference portion. During lamp manufacture, the third metal bodies may be accommodated in a jig positioned by means of their reference portions, whereupon the lamp vessel with the first and second metal bodies is introduced into the jig. The aligned surfaces are then shifted in contact with the base of the third metal bodies until the electric element has been brought to within a predetermined tolerance region. The second and the third metal bodies are then interconnected two-by-two.

A favorable embodiment is one in which both the second and the third metal bodies are U-shaped and the third metal body surrounds the second metal body with sliding fit. The position of the aligned surface of the second metal body, not only in the y-direction, its distance to the axis, but also its laterally shifted position relative to the axis (x-direction), is then accurately transferred to the third metal body. The electric element may then be easily brought to within a chosen tolerance region in the z-direction (axial direction) through axial displacement of the lamp vessel. In this embodiment, the legs of the second metal body also enhance the rigidity of the legs of the third body for the case in which the latter are loaded with mutually opposed pressures.

The reference portions may be, for example, bulges which face away from one another or face towards one another, created, for example, through deformation of the material of the third metal body.

Openings may be present in the legs of the second metal body at the areas of the reference portions of the third metal body. If so desired, retaining members of a luminaire which have a fixed position relative to an optical center of the system may grip the third metal body through said openings.

The metal bodies may be formed from metal plating, for example from chromium-nickel steel. Their positions on the necks may be determined in dependence on the optical system in which the lamp will be used, for example the dimensions of a reflector. The two mounting members may then lie much closer together than do the end portions of the necks.

The electric element of the lamp may be an incandescent body, for example in a gas comprising halogen, or a pair of electrodes between which a discharge in an ionizable gas takes place during operation. The electric element may be accommodated in an inner envelope, but generally it will be favorable for the electric element to be surrounded in a vacuumtight manner by the lamp vessel only so as to avoid reflections which interfere with the radiation path.

BRIEF DESCRIPTION OF THE DRAWINGS

An embodiment of the electric lamp according to the invention is shown in the drawing, in which.

DESCRIPTION OF THE PREFERRED EMBODIMENTS

Figure 1:
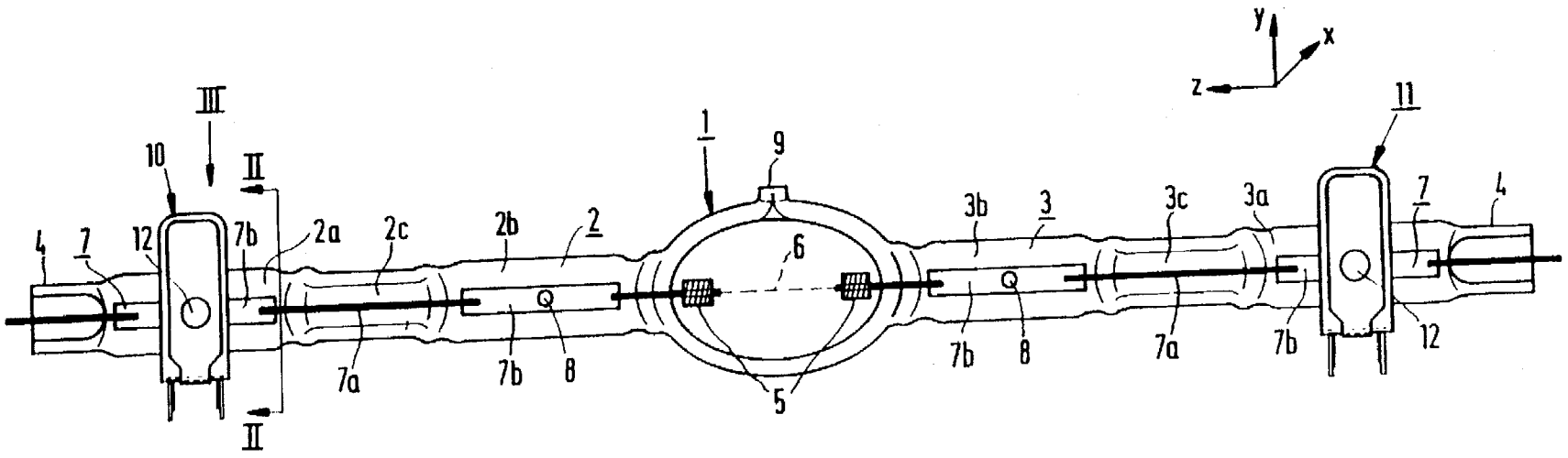
FIG. 1 shows an electric lamp in side elevation.

In FIG. 1, the electric lamp has a light-transmitting lamp vessel 1 which is closed in a vacuumtight manner and is made of glass with an $SiO_2$ content of at least 96% by weight in FIG. 1, for example quartz glass, with a first 2 and a second neck 3 in mutual opposition and each having an end portion 4. An electric element 5, a pair of electrodes in FIG. 1, with an axis 6 in the direction of the necks, i.e. the neck-shaped portions, 2, 3 is arranged in the lamp vessel. The lamp vessel is filled with an ionizable filling of, for example, mercury, rare gas and metal halides, for example a mixture of iodides and bromides. Current conductors 7 extend from the electrical element 5 through the first 2 and second neck 3, as applicable, from the relevant end portion 4 to the exterior. The lamp shown is not (yet) provided with lamp caps, which have electric contacts connected to the current conductors. A first and a second mounting member 10, 11 are fastened to the first and the second neck 2, 3, respectively. The mounting members each have reference portions 12 which occupy predetermined positions relative to the electric element 5 in a direction z parallel to the axis 6 and in directions x, y transverse to this axis.

The lamp shown has no outer envelope. The lamp vessel has a fused exhaust tube tip 9 which was created after the lamp vessel had been given its ionizable filling.

The necks 2, 3 of the lamp shown each have two pinched seals **2*a*, 2*b*, and 3*a*, 3*b*, respectively, in both cases with a respective intermediate chamber 2*c*, 3*c* filled with a gas, for example nitrogen, through which chamber a straightened wire portion 7*a* of the relevant current conductor 7 extends. A metal foil 7*b* is embedded in each of the seals 2*a*, 2*b*, 3*a*, 3*b* of the necks 2, 3. The chambers 2*c*, 3*c* provide the current conductors 7** with an effective cooling, so that they issue to the exterior at a lower temperature, given a certain lamp length.

The lamp shown is suitable inter alia for use as an outdoor lamp, for example a sports ground illumination lamp, and consumes a power of approximately 1800 W during nominal operation.

Figure 2:
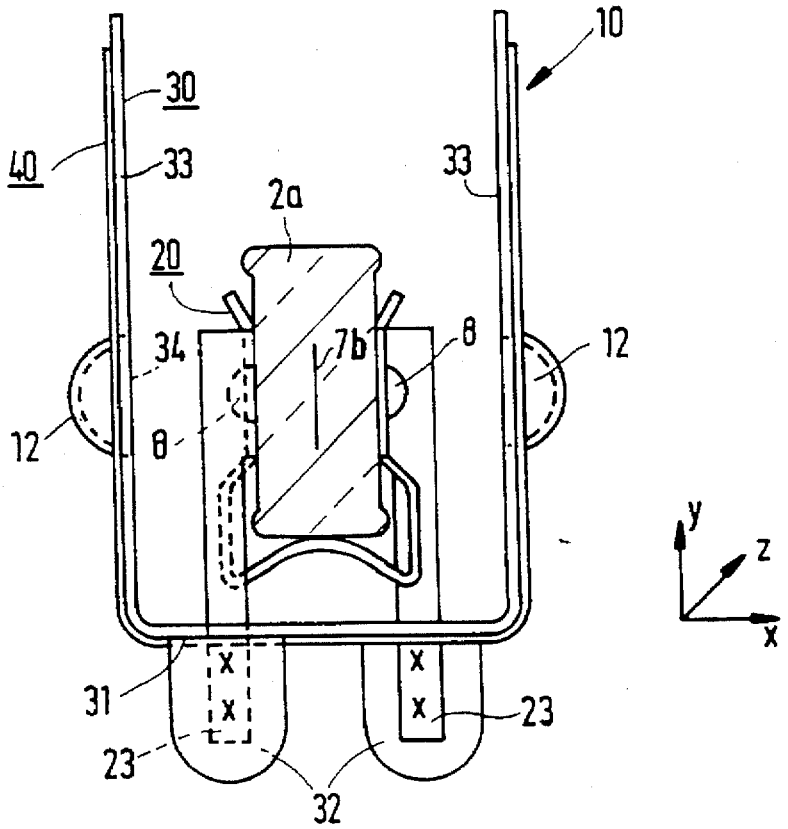
FIG. 2 is a cross-section taken on the line II—II in FIG. 1.
Figure 3:
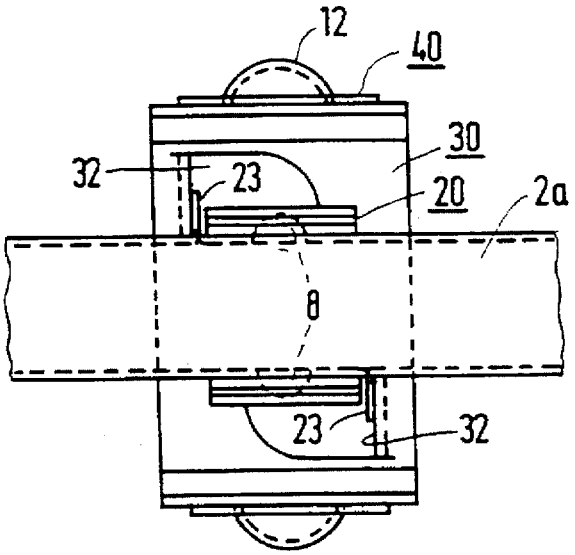
FIG. 3 is an elevation along III in FIG. 1.

The first 10 and the second mounting member 11 are at a distance from the relevant end portions 4 and each have, see also FIGS. 2 and 3:

a first metal body 20 mounted on the relevant neck 2, 3 in a region at a distance from the end portion 4, and a second metal body 30 fastened to the first metal body 20, the second metal body 30 having an aligned surface 31 which is aligned relative to the electric element 5 in at least one of the directions x, y and z, and a third metal body 40 provided with the reference portions 12 and fastened against said aligned surface 31 of the second metal body 30 such that the reference portions 12 occupy the predetermined positions relative to the electric element 5.

Figure 4:
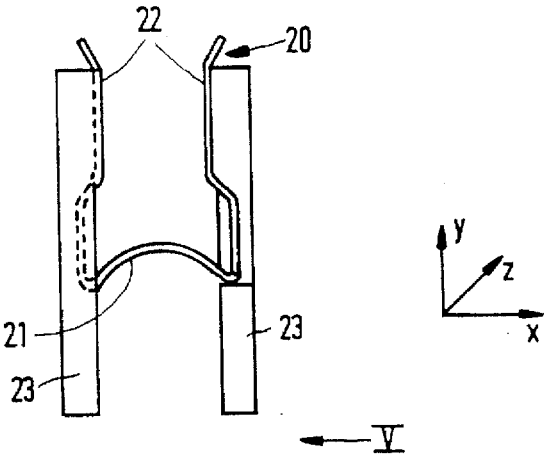
FIG. 4 shows the first metal body of FIG. 2.
Figure 5:
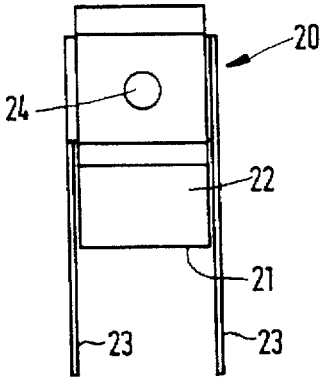
FIG. 5 shows the first metal body taken on the line V in FIG. 4.

The first metal body 20, see also FIGS. 4 and 5, is a clip with a base 21 and legs 22 interconnected by the base, the legs 22 clamping around the neck 2, 3.

The neck 2, 3 has a relief 8 at a surface, see FIG. 2, at the area of the first metal body 20, locking the first metal body 20 against shifting in the direction of the axis 6. The relief projects through openings 24 in the legs 22. The necks 2, 3 also have such reliefs in other places, on the seals **2*b*, 3*b***, so that the clip may be mounted there, if so desired.

Tongues 23 are present on the legs 22. In the embodiment drawn, these tongues have been flanged transversely relative to the legs 22, see also FIG. 3, so that they have a comparatively great stiffness in directions transverse to the legs. The legs are welded to the second metal body 30, see FIGS. 2 and 3. The clip has been given a comparatively great rigidity thereby.

The first metal body shown has an axis of symmetry: in FIG. 4 there is a tongue on the right behind a leg and the other tongue on the left in front of the other leg (see also FIG. 3). It does not make any difference, accordingly, whether the body is mounted in the position shown in FIG. 4 or has been rotated through 180° standing on its base. In addition, the tongues in this geometry have a maximum interspacing, all other dimensions being equal, so that a very stable construction is obtained.

Figure 6:
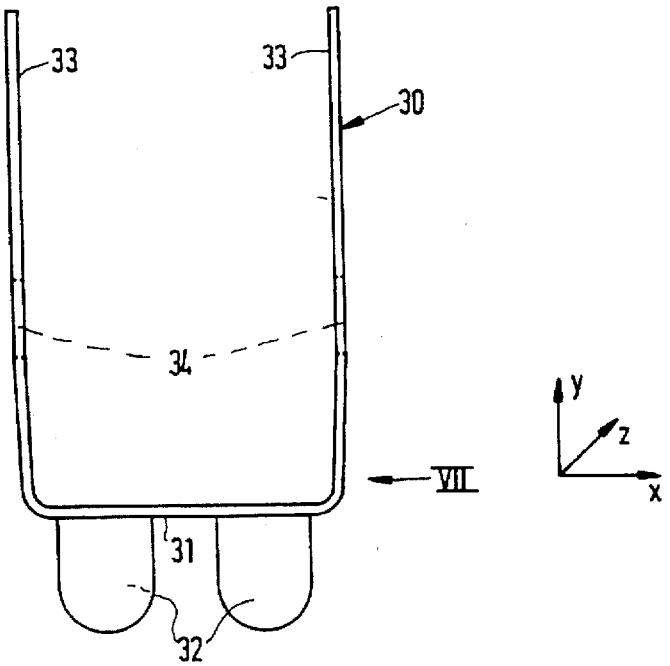
FIG. 6 shows the second metal body of FIG. 2.
Figure 7:
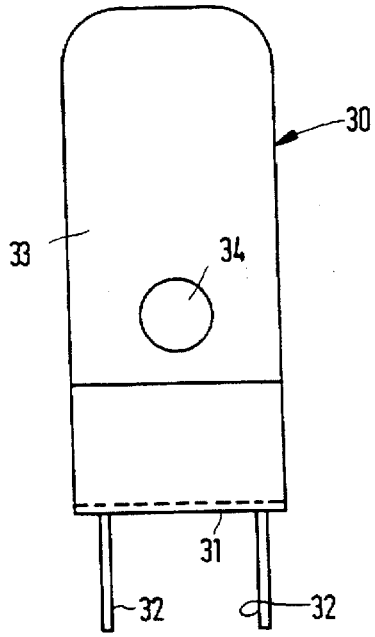
FIG. 7 shows the second metal body taken on the line VII in FIG. 6.

The second metal body 30, see FIGS. 2, 6, 7, has a fastening surface 32 which extends transversely to its aligned surface 31 and to which the first metal body 20 is fastened, see FIG. 2. The aligned surface 31 has been given a predetermined distance to the axis 6 thereby. The geometry is adapted to that of the first metal body 20 in that the fastening surface 32 is of a divided construction, so that it is of no importance again, also for the second metal body, whether it is mounted in the position shown or rotated through 180°, standing on its aligned surface 31.

The second metal body 30 is substantially U-shaped and is arranged around the axis 6, see FIG. 2. The second metal body has a base which forms the aligned surface 31 and legs 33 interconnected by said base. The aligned surface 31 is also aligned laterally of the axis 6, in the x-direction. This is possible in the embodiment shown in that the divided fastening surface was stamped and bent from the base and is wider than the tongues of the first metal body. Said tongues may as a result extend not only farther or less far along the fastening surface, but may also be displaced along this surface transversely to their own longitudinal directions.

The electric element 5 now can be eccentric in the z-direction only relative to the aligned surfaces 31 of the mounting members 10 and 11.

Figure 8:
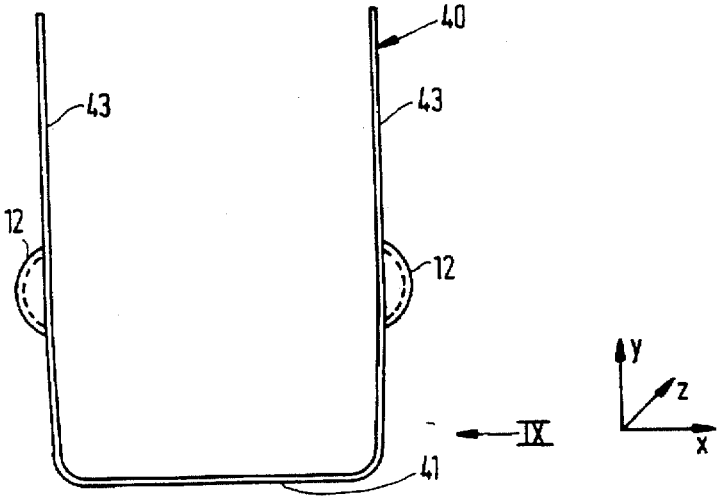
FIG. 8 shows the third metal body of FIG. 2.
Figure 9:
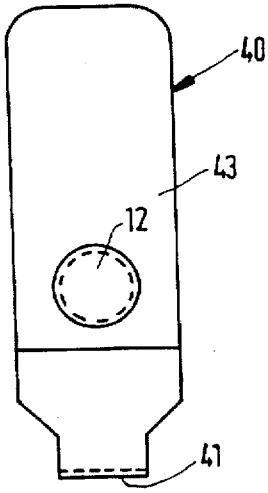
FIG. 9 shows the third metal body taken on the line IX in FIG. 8.

The third metal body 40, see FIGS. 2 and 8, is substantially U-shaped and arranged around the axis 6. This body 40 has a base 41 which is fastened against the aligned surface 31 of the second metal body 30, and legs 43 interconnected by the base 41. The legs 43 in these Figures each have a reference portion 12.

The third metal body 40 surrounds the second metal body 30 with sliding fit. As is apparent from FIGS. 2, 6 and 8, the second and the third metal bodies 30, 40 have a tapering portion near the aligned surface 31 and the base 41, so that an obtuse wedge shape is obtained at the base. The mounting member can as a result be placed more easily in a holder for the lamp present in a luminaire or optical system.

The reference portions 12, see FIGS. 2 and 8, are bulges which face away from one another. Openings 34, through which the reference portions 12 are accessible, are present in the legs 33 of the second metal body 30, see FIGS. 2 and 7, at the areas of the reference portions of the third metal body 40.

In the embodiment shown, the base 41 of the third metal body 40 is narrower than the base of the second metal body 30, so that the second metal body 30 is capable of a comparatively great displacement along the base 41 of the third metal body 40 during the alignment in the only direction, i.e. the z-direction, in which alignment is yet to take place in the embodiment shown before the third metal bodies are fastened against the associated aligned surfaces 31. The fastenings may be realised, for example, by means of resistance welds on the legs. It is favorable, however, to fasten the base 41 to the aligned surface 31 because these portions are then pressed against one another without play. The exhaust tube tip 9 is present at a side of the lamp vessel opposed to the bases of the mounting members, which points to a burning position of the lamp with the mounting member bases below said tip, so that the position of the tip is comparatively hot and no ionizable ingredients of the falling can accumulate there.

It will be understood that various modifications may be made to the embodiments shown herein. Therefore, the above description should not be construed as limiting, but merely as exemplifications of preferred embodiments. Those skilled in the art will envision other modifications within the scope and spirit of the claims appended hereto.

We claim:

1. An electric lamp comprising:

a light-transmitting lamp vessel which is closed in a vacuum tight manner and which has a first and a second neck in mutual opposition, each neck having an end portion;

an electric element having an axis in the direction of said necks and arranged in the lamp vessel;

current conductors extending from the electric element through the first and second neck from the respective end portions to the exterior;

a first and a second mounting member fastened to the first and the second neck, respectively, which mounting members each have reference portions which in a direction z parallel to the axis and in directions x, y transverse to the axis have predetermined positions relative to the electric element, wherein the first and the second mounting member are present at a distance from the end portion and each comprise a first metal body which is mounted on the associated neck in a region at a distance from the end portion, and each comprise a second metal body which is fastened to the first metal body, the second metal body having an aligned surface which is aligned relative to the electric element in at least one of the directions x, y and z, and each have a third metal body which is provided with the reference portions and which is fastened against said aligned surface of the second metal body such that the reference portions have the predetermined positions relative to the electric element.

2. An electric lamp as claimed in claim 1, wherein the first metal body is a clip with a base and legs interconnected by said base, which legs surround the neck with clamping force.

3. An electric lamp as claimed in claim 2, wherein the neck has a relief at a surface at the area of the first metal body, which relief locks the first metal body against shifting in the direction of the axis.

4. An electric lamp as claimed in claim 2, wherein tongues are present at the legs, which tongues are welded to the second metal body.

5. An electric lamp as claimed in claim 1, wherein the second metal body has a fastening surface which extends transversely to its aligned surface and to which the first metal body is fastened, the aligned surface having a predetermined distance to the axis.

6. An electric lamp as claimed in claim 5, wherein the second metal body is substantially U-shaped and is arranged around the axis, while the second metal body has a base which forms the aligned surface and legs which are interconnected by said base, and the aligned surface is also aligned laterally relative to the axis in the x-direction.

7. An electric lamp as claimed in claim 1, wherein the third metal body is substantially U-shaped and is arranged around the axis, while said body has a base which is fastened against the aligned surface of the second metal body and legs interconnected by the base, which legs each have a reference portion.

8. An electric lamp as claimed in claim 6, wherein the third metal body is substantially U-shaped and is arranged around the axis, while said body has a base which is fastened against the aligned surface of the second metal body and legs interconnected by the base, which legs each have a reference portion while the third metal body surrounds the second metal body with sliding fit.

9. An electric lamp as claimed in claim 1, wherein the reference portions are bulges which face away from one another.

10. An electric lamp as claimed in claim 9, wherein openings are present in the legs of the second metal body at the areas of the reference portions of the third metal body.

* * * * *